US012168945B1

(12) United States Patent
Lawrence et al.

(10) Patent No.: US 12,168,945 B1
(45) Date of Patent: Dec. 17, 2024

(54) BREATHER FOR CRANKCASE VENTILATION SYSTEM

(71) Applicant: Caterpillar Inc., Peoria, IL (US)

(72) Inventors: Rodney Allen Lawrence, Frankfort, IN (US); Joshua Amiel Lehe, West Lafayette, IN (US); Derek M. Heinis, St. Louis Park, MN (US); Brandyn A Stack, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/393,003

(22) Filed: Dec. 21, 2023

(51) Int. Cl.
*F01M 13/04* (2006.01)

(52) U.S. Cl.
CPC ..... *F01M 13/04* (2013.01); *F01M 2013/0438* (2013.01)

(58) Field of Classification Search
CPC ..... F01M 13/04; F01M 2013/0438
USPC ..... 123/572
See application file for complete search history.

(56) References Cited

U.S. PATENT DOCUMENTS

| | | | | |
|---|---|---|---|---|
| 3,073,293 | A | 1/1963 | Barker | |
| 6,065,457 | A * | 5/2000 | Hoffmann | F01M 13/0416 123/572 |
| 6,691,687 | B1 * | 2/2004 | Liang | F01M 13/04 123/573 |
| 7,343,833 | B2 | 3/2008 | Matsushima | |
| 7,475,681 | B2 | 1/2009 | Kuji et al. | |
| 9,359,924 | B2 | 6/2016 | Kalayci et al. | |
| 10,132,217 | B2 | 11/2018 | Lawrence et al. | |
| 2014/0290634 | A1 * | 10/2014 | Slaughter | F01M 13/0416 123/573 |
| 2017/0002704 | A1 * | 1/2017 | Takada | F01M 13/04 |
| 2017/0276040 | A1 * | 9/2017 | Lawrence | F01M 13/04 |
| 2020/0025048 | A1 * | 1/2020 | Konishi | F01M 13/0416 |

FOREIGN PATENT DOCUMENTS

| | | | |
|---|---|---|---|
| DE | 102011005795 A1 * | 12/2011 | F01M 13/04 |
| DE | 112015000392 T5 * | 9/2016 | F01M 13/04 |
| IN | 202121010575 | 9/2022 | |
| JP | 3666276 | 6/2005 | |
| WO | 2022040416 | 2/2022 | |

OTHER PUBLICATIONS

DE-102011005795-A1 (Horiuchi et al.) (Dec. 8, 2011) (Machine Translation) (Year: 2011).*
DE-112015000392-T5 (Peck et al.) (Sep. 9, 2016) (Machine Translation) (Year: 2016).*

* cited by examiner

*Primary Examiner* — Mahmoud Gimie
(74) *Attorney, Agent, or Firm* — Schwegman Lundberg & Woessner, P.A.

(57) ABSTRACT

Apparatuses, systems and methods are disclosed including a breather remote from an engine housing. The breather can be configured to be in fluid communication with a blow-by gas of the engine, and an oil separating apparatus. The breather can be configured to separate oil from the blow-by gas with a first filter media. The oil separating apparatus can be configured to be in fluid communication with the blow-by gas and can be configured to further separate oil from the blow-by gas with a second filter media. The breather and the oil separating apparatus can be configured to be coupled directly together such that an outlet of the breather communicates directly with an inlet of the oil separating apparatus with no intermediate component therebetween facilitating communication.

19 Claims, 10 Drawing Sheets

BREATHER FOR CRANKCASE VENTILATION SYSTEM

TECHNICAL FIELD

The present disclosure relates to internal combustion engines such as those for vehicles or stationary power generation. More particularly, the present disclosure relates to a breather for a crankcase ventilation systems for use with internal combustion engine.

BACKGROUND

Machinery, for example, agricultural, industrial, construction or other heavy machinery can be propelled by an internal combustion engine(s). Internal combustion engines can be used for other purposes such as for power generation. Internal combustion engines combust a mixture of air and fuel in cylinders and thereby produce drive torque and power. A portion of the combustion gases (termed "blow-by") may escape the combustion chamber past the piston and enter undesirable areas of the engine such as the crankcase. Blow-by can contain un-combusted fuel, oil and explosive gases. In rare cases, un-combusted fuel and/or explosive gases can build within the engine such as within the crankcase. The un-combusted fuel and/or explosive gases can result in an explosion if not properly mitigated such as by a relief valve. Crankcase ventilation systems are known in combustion engines to vent, capture or dilute blow-by gases of the crankcase. Such ventilation systems can include oil separating apparatuses as part of such systems. For example, U.S. Pat. No. 7,475,681B2, Japanese Patent No. 3,666,276B2 and PCT Application Publication No. WO202240416A1 disclose examples of breathers that are part of crankcase ventilation system. However, patents and publications do not utilize breather and a crankcase ventilation system constructed in a manner as disclosed herein.

SUMMARY

In an example according to this disclosure, a breather for a ventilation system of an internal combustion engine is disclosed. The breather can optionally include: a housing, a baffle, a plate and a filter media. The housing can form an inlet, an outlet and an internal manifold in fluid communication with the inlet and the outlet. At least a first portion of the housing can form a flow passage separate from the internal manifold for receiving a heated fluid that warms the internal manifold and the at least the first portion of the housing. The baffle can be positioned in the internal manifold. The plate can be positioned in the internal manifold and can include a plurality of apertures. The filter media can be in the internal manifold adjacent the plate.

In some examples according to this disclosure, an engine system is disclosed. The engine system can optionally include: a housing defining a crankcase configured to have a blow-by gas passing therethrough; a breather remote from the housing and configured to be in fluid communication with the blow-by gas, and an oil separating apparatus. The breather can be configured to separate oil from the blow-by gas with a first filter media. The oil separating apparatus can be configured to be in fluid communication with the blow-by gas and can be configured to further separate oil from the blow-by gas with a second filter media. The breather and the oil separating apparatus can be configured to be coupled directly together such that an outlet of the breather communicates directly with an inlet of the oil separating apparatus with no intermediate component therebetween facilitating communication.

In some examples, a method of filtering oil from a blow-by gas of an internal combustion engine is disclosed. The method can optionally include: passing the blow-by gas from a crankcase of the internal combustion engine to a breather coupled directly to an oil separating apparatus, separating a first amount of oil from the blow-by gas with a first filter media within the breather, passing the blow-by gas from an outlet of the breather directly to an inlet of the oil separating apparatus, separating a second amount of oil from the blow-by gas with a second filter media within the oil separating apparatus, and passing the blow-by gas from the oil separating apparatus back to the crankcase.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Examples according to this disclosure are directed to a breather for internal combustion engines, and to systems and methods including the breather and one or more oil filtering apparatuses for filtering oil to separate oil and other forms of particulate matter from blow-by gas. Examples of the present disclosure are now described with reference to the accompanying drawings. The following description is merely exemplary in nature and is not intended to limit the present disclosure, application, or use. Examples described set forth specific components, devices, and methods, to provide an understanding of embodiments of the present disclosure. It will be apparent to those skilled in the art that specific details need not be employed and that examples may be embodied in many different forms. Thus, the examples provided should not be construed to limit the scope of the claims.

Figure 1:
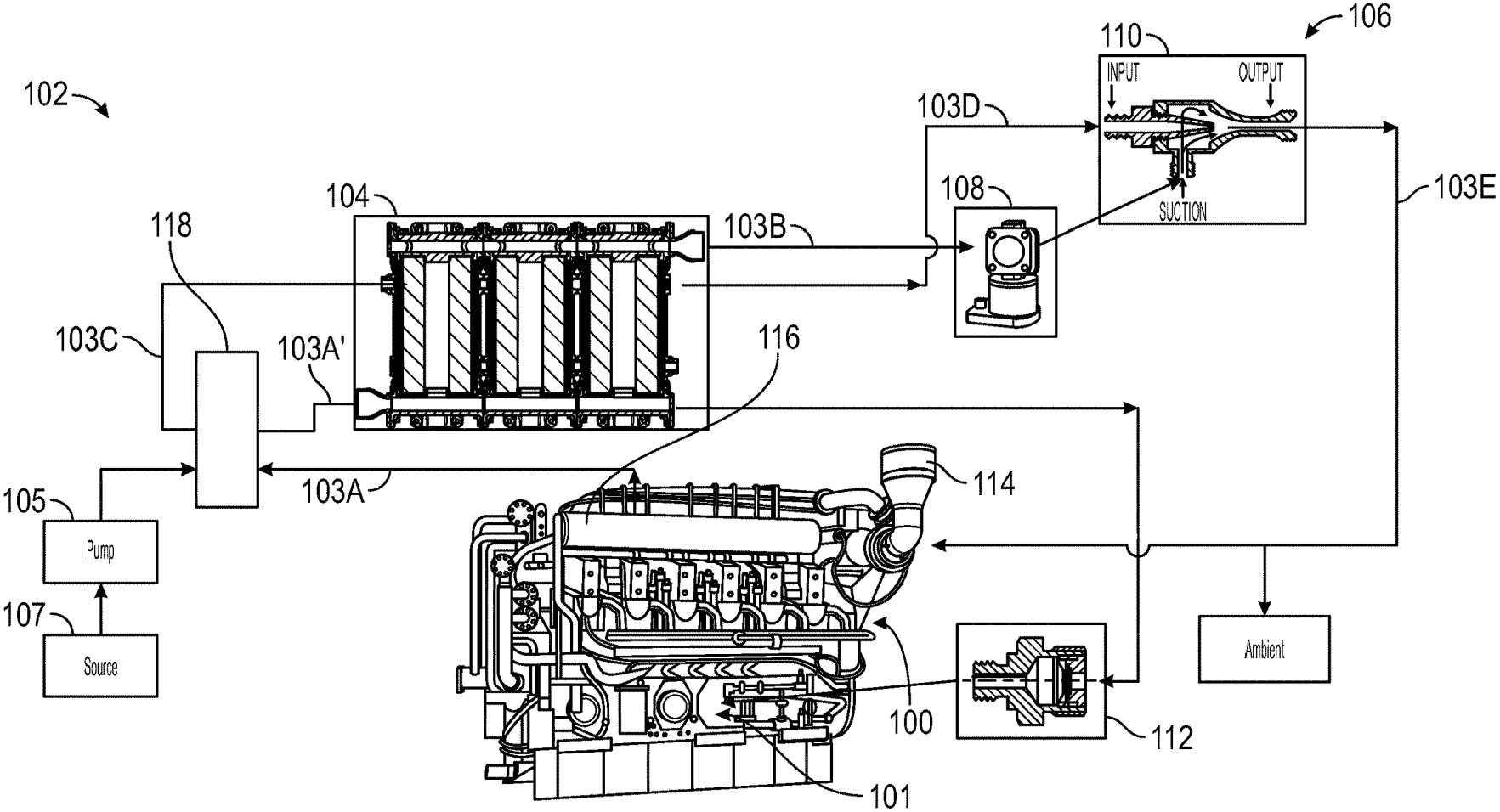
FIG. 1 is a schematic illustration depicting an example internal combustion engine with a ventilation system including both a breather and an oil separating apparatus in accordance with an example of the present application.

FIG. 1 depicts an example schematic illustration of an engine 100 in accordance with this disclosure. The engine 100 can be used for power generation such as for the propulsion of vehicles or other machinery. The engine 100 can include various power generation platforms, including, for example, an internal combustion engine, whether gasoline, natural gas, dynamic gas blending, or diesel. It is understood that the present disclosure can apply to any number of piston-cylinder arrangements and a variety of engine configurations including, but not limited to, V-engines, inline engines, and horizontally opposed engines, as well as overhead cam and cam-in-block configurations.

In some applications, the internal combustion engines disclosed here are contemplated for use in gas compression. Thus, the internal combustion engines can be used in stationary applications in some examples. In other applications the internal combustion engines disclosed can be used with vehicles and machinery that include those related to various industries, including, as examples, oil exploration, construction, agriculture, forestry, transportation, material handling, waste management, etc.

The engine 100 can include a ventilation system 102 with at least one oil separating apparatus 104 (an array of a plurality of oil separating apparatuses 104 is shown but will simply be discussed as the oil separating apparatus in FIG. 1). The system 102 can include auxiliary components 106 to the engine 100 such as a regulator 108, jet pump 110 and a check valve 112. The check valve 112 can be placed, for example, at the bottom of the oil drain sub-system to prevent unfiltered blow-by gas from bypassing a coalescing filter of the oil separating apparatus 104 and passing directly to a compressor 114. Thus, the check valve 112 can regulate the flow of oil.

In the example of FIG. 1, the ventilation system 102 can be part of the original manufacture of the engine 100 or can be a retrofitted system that is added to the engine 100 during maintenance, upgrade or the like. As will be discussed in further detail subsequently, the ventilation system 102 can use one or more breathers (e.g., breather 118) and the oil separating apparatus 104 to filter oil from the blow-by gas to reduce volatile content in the blow-by gas.

The ventilation system 102 can be in fluid communication with a crankcase 101 of the engine 100 such as via an inlet passageway. The ventilation system 102 can be configured to supply air to the crankcase and through the engine block or through other components (not shown) to a cylinder head of the engine 100. The air the ventilation system 102 supplies can act to ventilate the crankcase 101 and other components of the engine 100 such as the cylinder head, the rocker box, etc. This ventilation, in addition to operation of the breather 118 and the oil separating apparatus 104 to separate oil from the blow-by gas, can dilute un-combusted fuel, explosive gases and/or volatiles below a lower explosive limit so as to prevent or reduce the likelihood of an explosion within the engine 100.

The ventilation system 102 can include connected passages (some specifically illustrated by arrows and numbered in FIG. 1) that are in fluid communication with various components of the ventilation system 102. Some components of the engine 100 such as the engine block, the crankcase 101, the cylinder head, the rocker box, the valve cover and/or the breather can be in fluid communication. The terms "passage," "passages," "passageway," "passageways", "line" or "lines" as used herein should be interpreted broadly. These terms can be features defined by the various components of the engine illustrated in the FIGURES or can be formed by additional components (e.g., a hose, tube, pipe, etc.) as known in the art. These additional components can be external to the engine 100 in some examples. Passageways can also connect the regulator 108, the jet pump 110 and the check valve 112 with selected parts of the oil separating apparatus 104 as further described herein. It should be noted that although passages 103A' and 103C are shown between the breather 118 and the oil separating apparatuses 104 in FIG. 1, this arrangement to include such intermediate components is purely optional.

Embodiments disclosed herein contemplate that the breather 118 can mount directly on the oil separating apparatus 104 such that an outlet of the breather 118 for the blow-by gas communicates directly with an inlet of the oil separating apparatus 104 for the blow-by gas with no intermediate component therebetween facilitating such direct communication. Similarly, a fluid can be passed directly between the breather 118 and the oil separating apparatuses 104 such as via a jumper tube of the breather 118 in some embodiments discussed herein.

The ventilation system 102 can include passages and other components such as those shown in FIG. 1. Dirty blow-by gas containing oil and volatiles of the system 102 can pass along a passage 103A from the engine 100 to the breather 118 and can then pass from the breather 118 along a passage 103A' (or directly without use of the passage 103A' as further discussed herein) to the oil separating apparatus 104. Both the breather 118 and the oil separating apparatus 104 are configured for filtering of oil to reduce volatile content of the blow-by gas. The breather 118 can be configured to filter the oil before it is passed to a single or a plurality of the oil separating apparatuses 104. The blow-by gas, after filtering of the oil, can pass from the oil separating apparatus 104 along passage 103B to the regulator 108 (e.g., a vacuum control valve, mechanical valve or similar regulating device) located between the oil separating apparatus(es) 104 and the jet pump 110. The blow-by gas can pass from the regulator 108 to the suction of the jet pump 110. The regulator 108 (e.g., the vacuum control valve) can be in fluid communication with the blow-by gas. The regulator 108 can be configured to regulate a flow of the blow-by gas to control a vacuum of the jet pump 110.

The system 102 can utilize fluid such as engine coolant, jacket water, boost air, engine lube oil or an off engine fluid. This fluid can be circulated by a pump 105 from a source 107 to the breather 118 and to a jacket of the oil separating apparatus 104. Use of the fluid can maintain the filter media of the breather 118 and the filter media of each oil separating apparatus 104 at between about 40 degrees Celsius and 80 degrees Celsius, for example. The fluid can have a temperature range above the dew point temperature of the blow-by gas and below a temperature at which one or more components of the oil separating apparatus 104 and/or the breather 118 become inoperable (fail due to melting or another modality). As an example, in tandem with the blow-by gas, the system 102 can utilize boost air from the compressor 114 (or other component such as a turbocharger) and/or air from an aftercooler 116. Thus, one or more of these components can be the source 107. A mass flow rate of the boost air can be between 0.5% and 2.5% of a mass flow rate of the air received by the compressor 114. This boost air can be mixed in a desired ratio and passed through the breather 118 and can be passed to one or more jackets of the oil separating apparatus 104. For example, the boost air can be mixed to achieve a temperature range above the dew point temperature of the blow-by gas and below a temperature at which one or more components of the oil separating apparatus and/or breather 118 become inoperable (fail due to melting or another modality).

With the boost air example, after leaving the jacket(s), the boost air, now at a reduced pressure and temperature from a pressure and temperature leaving the engine 100, can pass along passage 103D to an input of the jet pump 110. The jet pump 110 can use the boost air as motive air for drawing the blow-by gas through the oil separating apparatus(es) 104. The blow-by gas after leaving the oil separating apparatus (es) 104 can be routed to a suction port of the jet pump 110. The boost air can be routed to an inlet port of the jet pump 110. The blow-by gas and the boost air can be combined in the jet pump 110. In particular, jet pump 110 can be configured to pass the blow-by gas and the boost air through a venturi of the jet pump 110. Some or all of the combined motive air and blow-by gas can pass along passage 103E to be returned to the engine 100, for example, as an inlet to the compressor 114. Some or all of the combined motive air and blow-by gas can also be routed to ambient. The air can pass to the compressor 114, which can be configured to receive and compress the air. The compressed air can pass from the compressor 114 to the aftercooler 116. Thus, the aftercooler 116 can be in fluid communication with the compressor 114. The aftercooler 116 can be configured to receive and cool at least a portion of the compressed air.

To briefly summarize, the crankcase 101 can having a blow-by gas passing therethrough. The breather 118 and the oil separating apparatus(es) 104 can be in fluid communication with the blow-by gas and configured to separate oil from the blow-by gas. The fluid can be selectively passed through the breather 118 and the oil separating apparatus(es) 104 in a heat exchange relationship with the blow-by gas to maintain a temperature of the blow-by gas within the breather 118 and the oil separating apparatus(es) 104 at a desired temperature range. In one example, the system 102 can include the jet pump 110 can be in fluid communication with both the blow-by gas after leaving the oil separating apparatus(es) 104 and boost air after leaving the oil separating apparatus(es) 104. The jet pump can be configured to combine the blow-by gas and the boost air. In particular, passage of the air through the jet pump 110 can create a vacuum that can be modulated by the regulator 108 (e.g., vacuum control valve or a mechanical valve). The regulator 108 can modulate the vacuum at the outlet of the system 102 and can regulate crankcase pressure (via flow of blow-by gas to the suction of the jet pump 110). After leaving the jet pump, the combined blow-by gas and the boost air can be routed to at least one of the compressor 114 or ambient.

Figure 2:
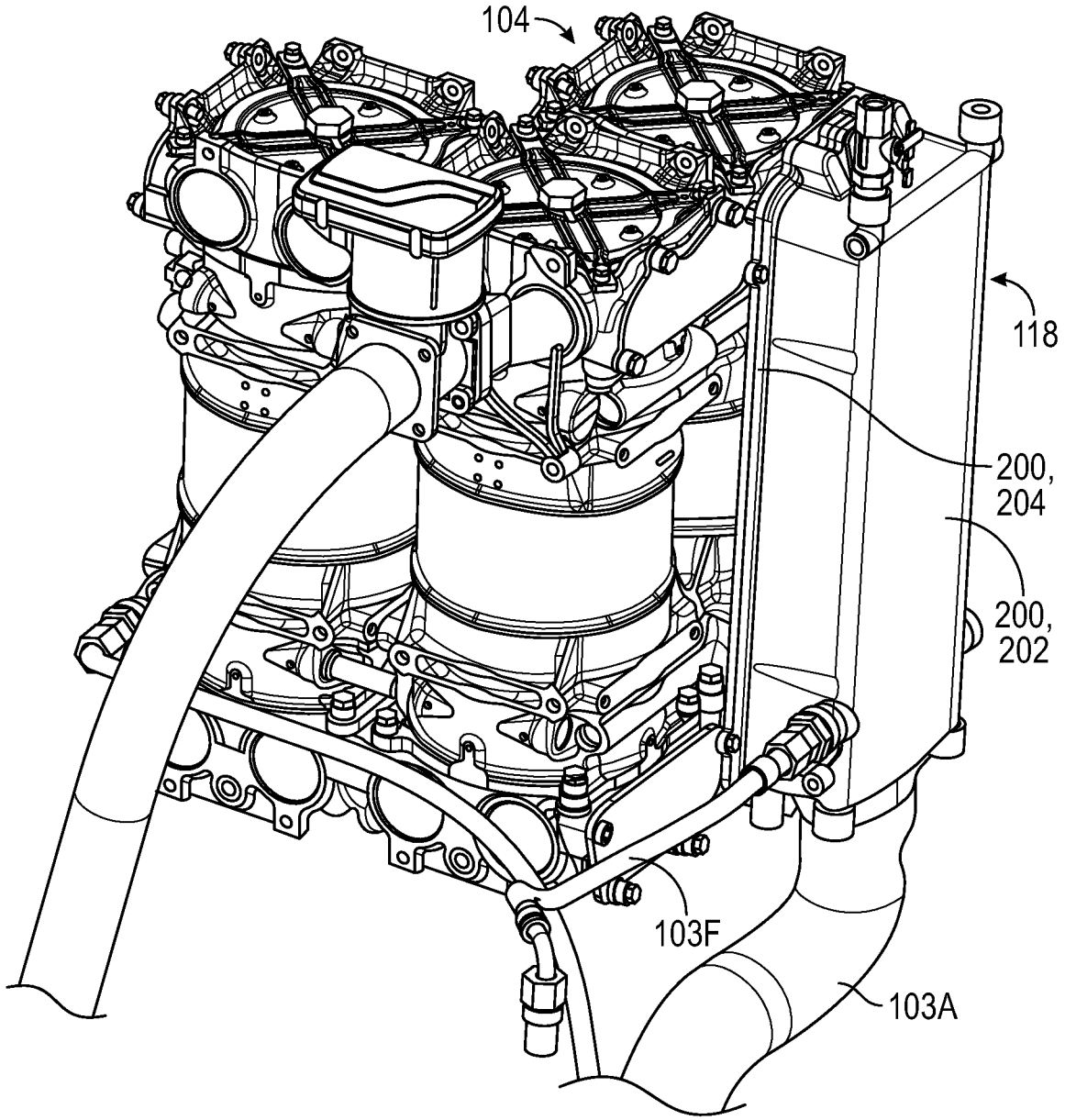
FIG. 2 is a perspective view of the breather mounted to one of a plurality of oil separating apparatuses according to one example of the present application.

FIG. 2 shows an example of the breather 118 that can be directly mounted to one oil separating apparatus 104 that can be used with the system 102 (FIG. 1) described previously. In particular, the breather 118 can be directly mounted in a backpack arrangement with the oil separating apparatus 104 and can serve as the breather for a plurality of oil separating apparatuses 104 configured as an array. The array can include any number of oil separating apparatuses communicating via inlet and/or outlet covers. The array can have various configurations (multi-row parallel arrangement, multi-row series arrangement, U-shaped arrangement, L-shape arrangement, T-shaped arrangement, H-shaped arrangement, single row arrangement, etc.)

FIG. 2 illustrates the passage 103A communicating blow-by gas from the engine (not shown) to the breather 118. FIG. 2 additionally shows a passage 103F used to communicate the fluid (see discussion above) to or from the breather 118. The breather 118 can include a housing 200 that includes a cover 202 and a mounting plate 204. Although the housing 200 is illustrated as having a two-piece construction other embodiments contemplate the housing 200 can be formed of more than two pieces. The housing 200 can be formed by casting or other suitable forming technique(s). The housing 200 can be configured to form an internal manifold as discussed and illustrated subsequently. This internal manifold can communicate with the passage 103A and with a manifold formed by an inlet cover of the oil separating apparatus 104, for example. The cover 202 can be coupled to and sealed to the mounting plate 204. The mounting plate 204 can be configured to couple directly to one or both of the inlet cover and/or the outlet cover of the oil separating apparatus 104. The mounting plate 204 can additionally couple to other parts of the oil separating apparatus 104 in some embodiments. According to one example, the breather 118 can have an elongate length of between 600 mm and 800 mm, a width of between 200 mm and 265 mm and a depth of between 100 mm and 150 mm. However, these dimensions are merely exemplary and can change based upon the mass flow rate of the blow-by gas and other operating criteria.

Figure 3:
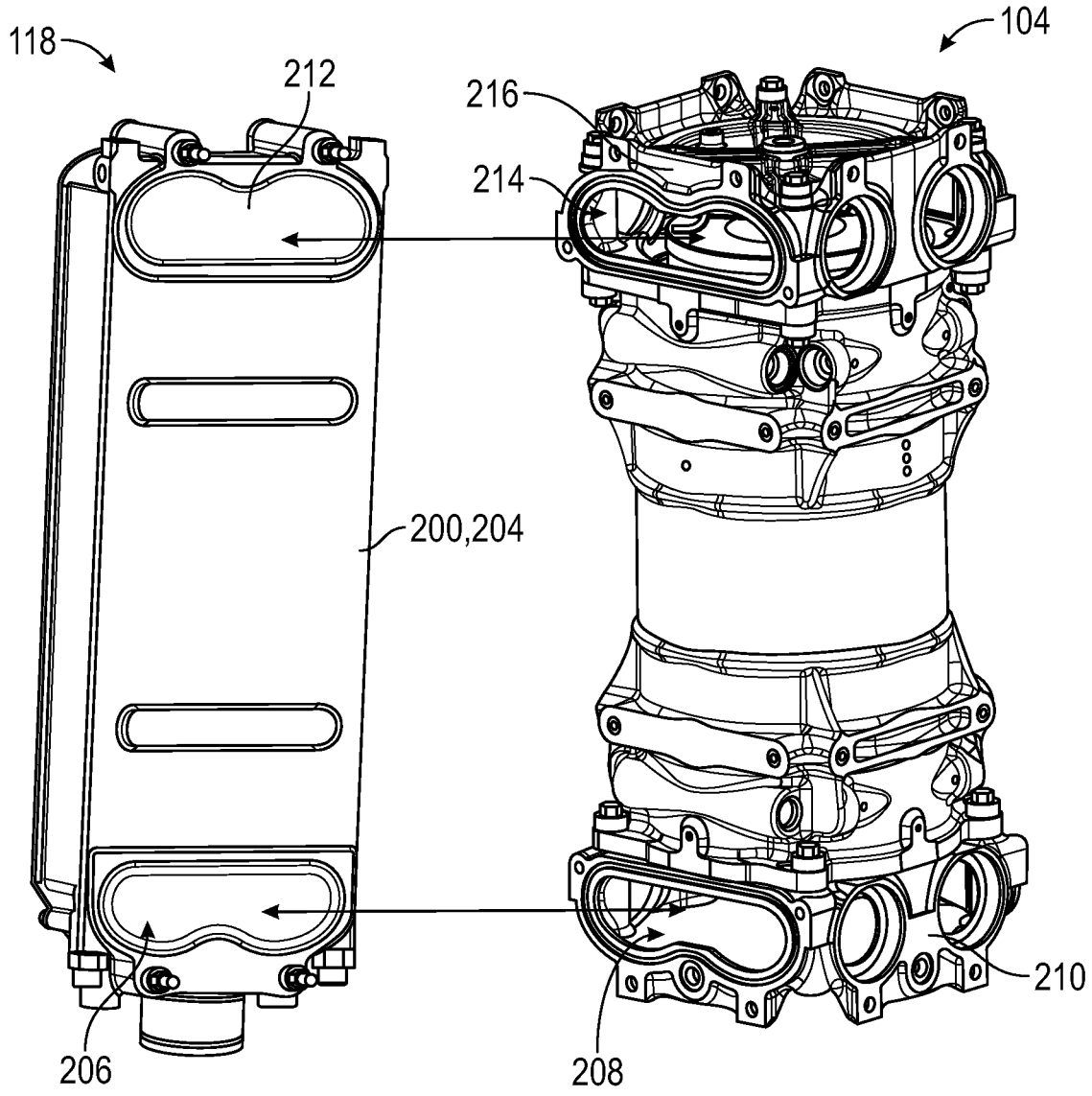
FIG. 3 is a perspective view showing the breather removed from the oil separating apparatus to illustrate an outlet of the breather and an inlet of the oil separating apparatus that are in direct fluid communication with one another according to one example of the present application.

FIG. 3 illustrates the breather 118 removed from the oil separating apparatus 104 to better illustrate the direct fluid communication arrangement between the two components. The housing 200, in particular, the mounting plate 204 can be configured to define an outlet 206 for the blow-by gas. The outlet 206 can be configured to communicate directly without any intermediate component with an inlet 208 of an inlet cover 210 of the oil separating apparatus 104. The mounting plate 204 can be sealed to a face of the inlet cover 210 using O-ring(s), fasteners or other types of devices as known in the art. A closure plate 212 can be coupled to the mounting plate 204 and can be configured to interface with one outlet 214 of a face of an outlet cover 216 of the oil separating apparatus 104. The closure plate 212 can be sealed to the face of the outlet cover 216 using O-ring(s), fasteners or other type of devices as known in the art. Thus, the breather 118 does not receive flow of blow-by gas back from the oil separating apparatus 104. The breather 118 can be attachable to and removable from the oil separating apparatus 104 (as indicated by arrows). Such removal can be for servicing of components of the breather 118 and/or the oil separating apparatus 104, for example. The housing 200 is configured to mount directly on the oil separating apparatus 104 such that the outlet 206 of the breather 118 communicates directly with the inlet 208 of the oil separating apparatus 104 with no intermediate component therebetween facilitating communication.

Figure 4:
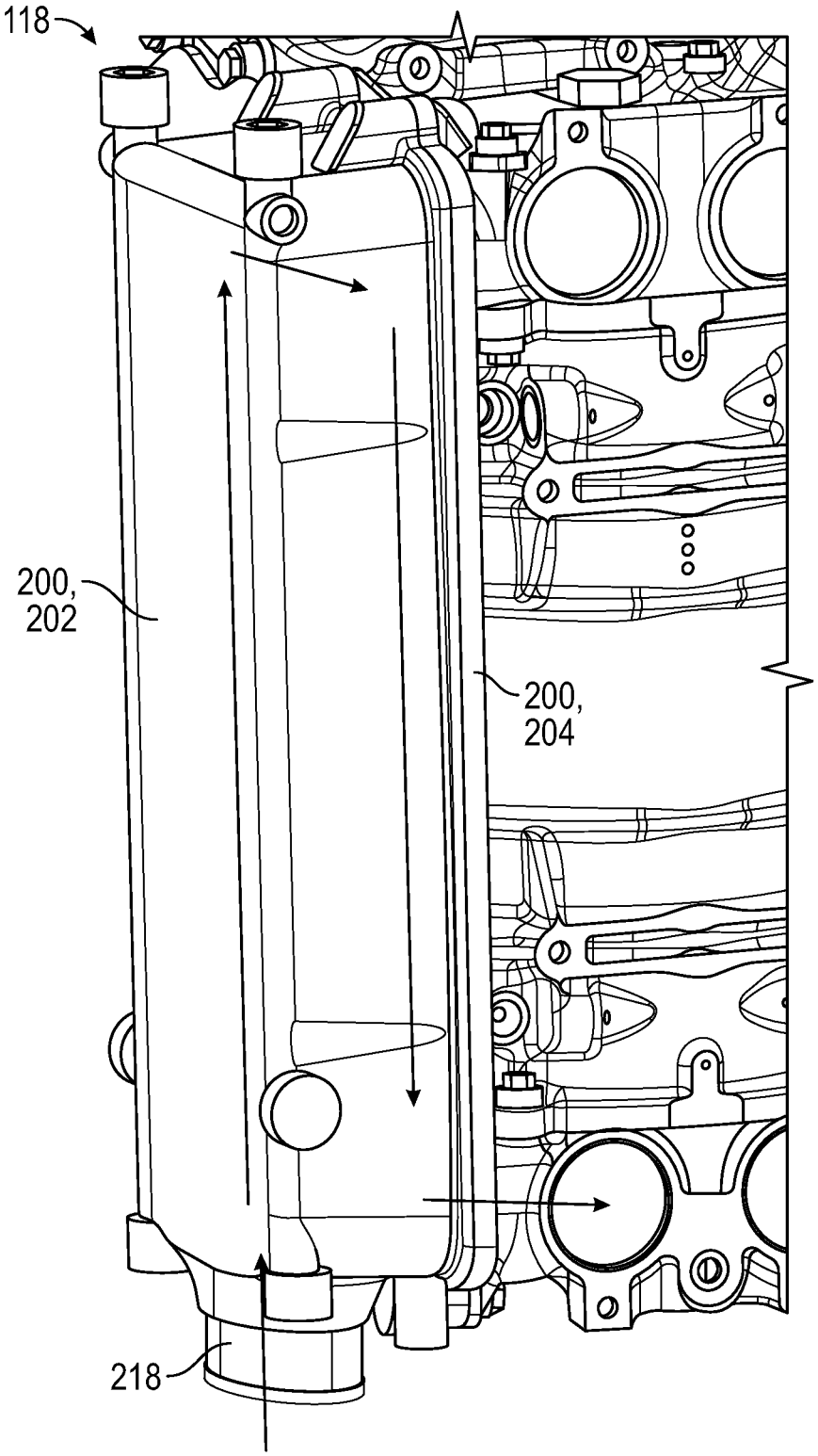
FIG. 4 schematically illustrates a flow path of a blow-by gas through the breather and into the inlet of the oil separating apparatus of FIG. 3.

FIG. 4 shows the breather 118 including the housing 200 with the cover 202 and the mounting plate 204. The housing 200, in particular the cover 202, can include an inlet 218 to the internal manifold. The inlet 218 can couple with the passage 103A (FIG. 2) to receive the blow-by gas. FIG. 4 schematically illustrates a flow of the blow-by gas within the breather 118 as illustrated with arrows. The blow-by gas can pass in a flow circuit as further discussed herein within the breather 118 and to the outlet 206 (FIG. 3) and into the oil separating apparatus 104.

Figure 5:
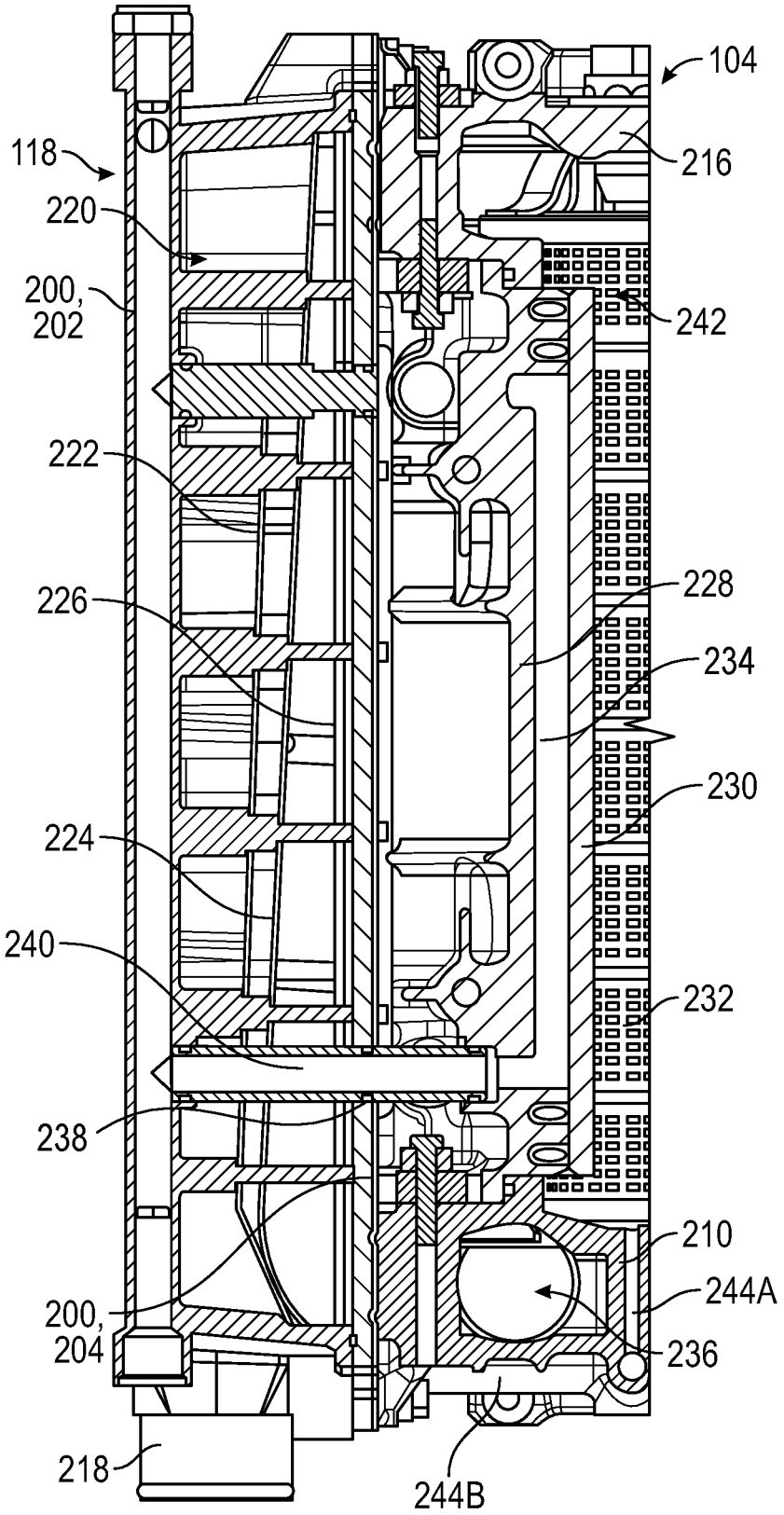
FIG. 5 is a cross-sectional view of the breather and a portion of the oil separating apparatus of FIGS. 3 and 4.

FIG. 5 shows a cross-section of the breather 118 and a cross-section of a portion of the oil separating apparatus 104. The breather 118 can include the housing 200 with the cover 202 and the mounting plate 204 as previously discussed. FIG. 5 additionally shows additional components of the breather 118 including an internal manifold 220, a baffle 222, a plate 224 and a filter media 226. These components will be further discussed in reference to FIG. 6.

FIG. 5 illustrates portions and components of the oil separating apparatus 104 including the inlet cover 210 and the outlet cover 216. Additionally, FIG. 5 illustrates an outer housing 228, an inner housing 230, a filter media 232 and a jacket 234.

The inlet cover 210 can include a housing designed to form one or more inlets including the inlet 208 (FIG. 2) and a manifold 236. The inlet cover 210 can be connected to a first end portion of the outer housing 228 by fastener, weld, solder, threading or other mechanical connection as known in the art. Similarly, the outlet cover 216 can be connected to a second end portion of the outer housing 228 in a similar manner to the inlet cover 210. The second end portion can generally oppose the first end portion.

The inlet cover 210 and/or the outlet cover 216 can be part of the outer housing 228 according to further examples rather than being a separate component. For example, the outer housing 228, the inlet cover 210 and/or the outlet cover 216 could comprise an integral single piece assembly according to some examples.

The inlet cover 210 and the outlet cover 216 can have a square, rectangular, circular, or other shape in cross-section as desired and can be constructed of any suitable material(s). The inlet cover 210 and the outlet cover 216 can form exterior walls having faces, one or more manifolds and other features. In brief, the inlet cover 210 can form a plurality of ports (inlets) for communication of blow-by gas into the oil separating apparatus 104 and for communication of the blow-by gas to additional of the oil separating apparatuses (now shown in FIG. 5 but seen in FIGS. 1 and 2).

The outer housing 228 can have a hollow tubular shape, for example. This shape can form an inner cavity configured to receive the inner housing 230. Thus, the inner housing 230 can be positioned within the outer housing 228. The inner housing 230 and the outer housing 228 can be constructed of suitable material(s). Although the outer housing 228 and the inner housing 230 are illustrated as separate components in the FIGURES, it is contemplated in some examples that these could be integrally formed as a single piece such as by casting or another forming technique. The outer housing 228 can form a wall with ports 238 passing through the wall. These ports 238 can provide inlet(s) or outlet(s) as desired and can be in fluid communication with the jacket 234. The jacket 234 can comprise a sealed (from the inner cavity, the blow-by gas, the oil, and filter media 232) cavity formed between an interior side of the wall of the outer housing 228 and an outer surface of the inner housing 230. Thus, the jacket 234 can be formed between the inner housing 230 and the outer housing 228.

As shown in FIG. 5, a second portion (e.g., the mounting plate 204) of the housing 200 opposes at least the first portion (e.g., the cover 202) of the housing 200. The second portion (e.g., the mounting plate 204) can interface with and can be adjacent the jacket 234 of the oil separating apparatus 104. The breather 118 can include a jumper tube 240 that extends from the breather 118 to communicate with one of the ports 238. The jumper tube 240 can be hollow allowing for passage of the fluid (see discussion above with regard to FIG. 1) directly between the breather 118 and the oil separating apparatus 104 (specifically the jacket 234). The breather 118 can include passages (discussed subsequently) that allow for communication of the fluid within the housing 200 of the breather 118. The fluid can be used to warm or maintain the filter media 226 of the breather 118 and the filter media 232 of the oil separating apparatus 104 to the desired temperature range, for example (see further discussion above with regard to FIG. 1). The ports 238 can be located at specifically configured flanges or other features of the outer housing 228. The flanges can form different faces of the outer housing 228. These faces of the outer housing 228 can correspond with faces of the inlet cover 210 and/or the outlet cover 216, for example.

Returning to the jacket 234, the jacket 234 can be cylindrically shaped having only the ports 238 for fluid communication. The jacket 234 can be configured to receive and pass the fluid. Other embodiments (not specifically shown) contemplate the jacket 234 and/or the passages of the breather 118 can be used to receive one or more of an electrical heater coil, an insulative material or a sealed air gap rather than the fluid. More particularly, electrically resistive heating coils can be placed in the jacket 234 and/or passages so as to provide heating to the inner housing 230, the filter media 232 and/or to the internal manifold 220 and of the filter media 226 of the breather 118. This can be useful if the oil separating apparatus 104 and breather 118 is being operated in a cold environment. Alternatively or additionally, insulative material such as foam or the like can be placed in the jacket 234 and passages to provide for insulation of the filter media 226 and/or filter media 232 (and blow-by gas) from a harsh environment.

A housing of the outlet cover 216 can form exterior walls, faces, one or more manifolds and other features of the outlet cover 216. The outlet cover 216 can be configured to form a plurality of ports for communication of blow-by gas out of the oil separating apparatus 104 such as to adjacent additional oil separating apparatuses as shown in FIG. 2. These ports can be selectively blocked including the outlet 206 (FIG. 3) as previously shown.

The outlet cover 216 can be designed to couple with a cover or service plug that can be selectively removable therefrom. This service plug can allow access to an inner cavity (formed by the inner housing 230) and the filter media 232. The filter media 232 can be accessed, removed and changed for a new filter with selective removal of the service plug from the outlet cover 216.

The inlet cover 210 can couple to the outer housing 228 so as to abut or be in close proximity to the filter media 232. The inner housing 230 can be positioned within the outer housing 228 and can be sealed thereto. The inner housing 230 can comprise a sleeve having a hollow construction forming an inner cavity for receiving the filter media 232.

The blow-by gas passing through from the breather 118 can have a first portion of oil removed by the filter media 226 before passing into the inlet cover 210 and then to the filter media 232. The filter media 232 is configured to separate a further portion of the oil contained in the blow-by gas. The filter media 232 can have a generally cylindrical shape about a central passage. The filter media 232 can have a construction known in the art such as being a coalescing filter. As an example, the filter media 232 can be constructed using a single or multi-layer synthetic coalescing filter media wound around a core, or pleated. In addition to the coalescing filter media, the coalescing filter will also include end caps and associated seals and may include an inner and outer perforated tube structure to provide the axial, torsional, and bending stiffness required for the application.

The blow-by gas containing oil can pass radially outward through the filter media 232 to an outer circumference thereof. During such passage, the configuration of the filter media 232 can cause coalescing of the oil from the blow-by gas. Such coalescing can result in separation of the oil from the blow-by gas. The oil once coalesced can travel to the outer circumference of the filter media 232 and can pass to an outer cavity 242 surrounding the outer circumference of the filter media 232. The inner housing 230 can be spaced from the outer circumference of the filter media 232. This gap can be the outer cavity 242. The blow-by gas that is separated from the oil by action of the filter media 232 can pass from the filter media 232 into the outer cavity 242 and can pass from the outer cavity 242 through one or more passages in fluid communication with a manifold into the outlet cover 216.

The inlet cover 210 can be configured to receive oil captured by both the filter media 226 of the breather 118 and the filter media 232 of the oil separating apparatus 104. In particular, the inlet cover 210 can be configured to form passages 244A and 244B. The passage 244A can receive oil captured by and drained from the filter media 232. The passage 244B can receive oil captured by one or more passage(s) 244A and route to ports located on each of the four faces of the inlet cover 210, as well as the bottom of the inlet cover 210. Put another way, according to one example, the coalesced oil from the filter media 226 within the breather 118 can drip off of the bottom of the filter media 226 and can run down into the outlet port 206. From the outlet port the oil can then pass into the inlet cover 210 blow-by manifold 236 (FIG. 5) (via the inlet 208 of FIG. 3) and then to a casting or other feature of the inlet cover 210. One or more faces of the inlet cover 210 can include a drainage port(s) for passing the oil from the inlet cover 210 and back to the engine as discussed previously in regard to FIG. 1. Thus, oil captured by the filter media 226 within the breather 118 can be passed to the oil separating apparatus 104.

Figure 6:
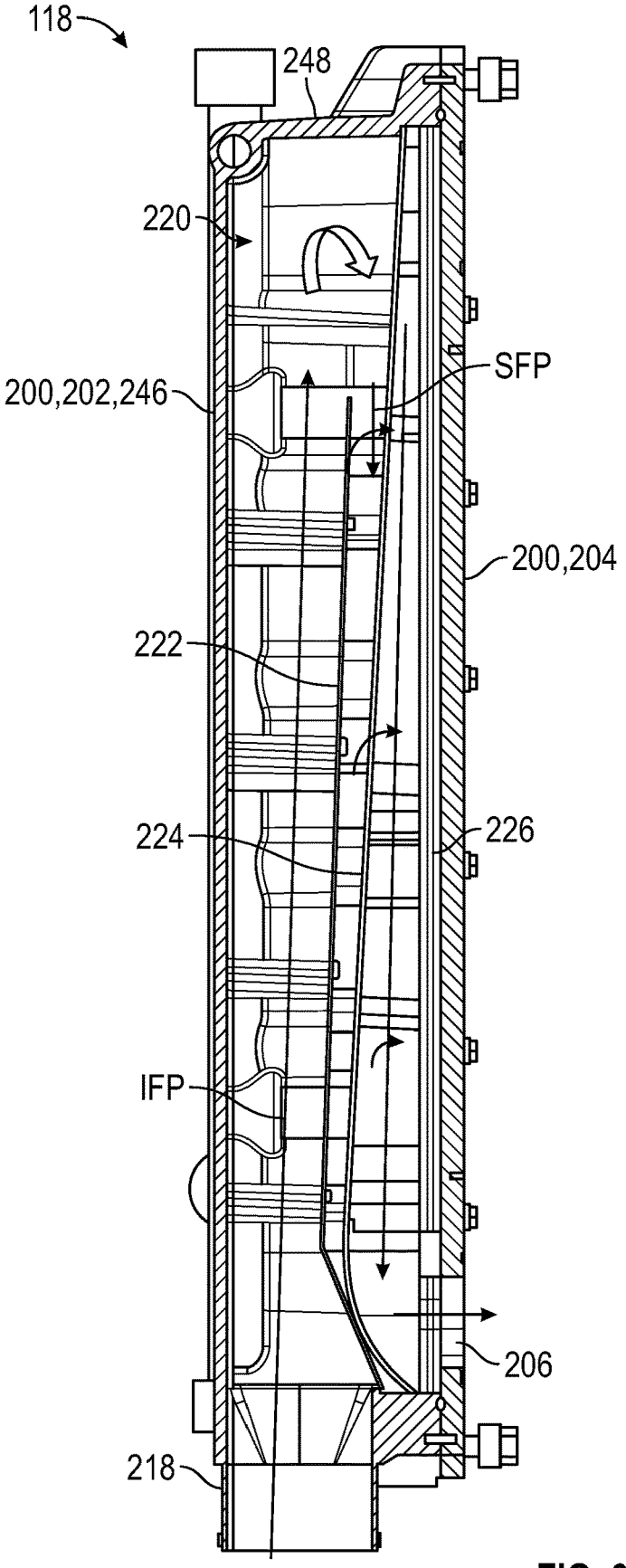
FIG. 6 is a cross-sectional view schematically illustrating a flow path of the blow-by gas therethrough according to an example of the present application.

FIG. 6 is a cross-sectional view of the breather 118 schematically illustrating flow paths of the blow-by gas with arrows. In particular, FIG. 6 shows the housing 200 with the cover 202 and the mounting plate 204, the outlet 206, the inlet 218, the internal manifold 220, the baffle 222, the plate 224 and the filter media 226.

The housing 200 can form the inlet 218, the outlet 206 and the internal manifold 220. The internal manifold 220 can be in fluid communication with the inlet 218 and the outlet 206. The baffle 222, the plate 224 and the filter media 226 can be at least partially or entirely positioned within the internal manifold 220. The filter media 226 can comprise one or a plurality of layers of oil capturing material. As will be discussed and shown subsequently, the plate 224 can include a plurality of apertures allowing for passage of the blow-by gas therethrough to reach and bombard the filter media 226. The filter media 226 can be positioned adjacent the mounting plate 204 at or near an edge of the internal manifold 220. The filter media 226 can be spaced from but can be located adjacent the plate 224. The filter media 226 can extend to cover substantially an entirety of an interior side of the mounting plate 204 that encloses the internal manifold 220.

As shown in FIG. 6, at least a majority of the baffle 222 can have an orientation that is inclined with respect to a first wall 246 (e.g., a top face of the cover 202) of the housing 200 and with respect to the flow direction. This orientation of the baffle 222 provides for an increasing cross-sectional area along an initial flow path IFP of the blow-by gas within the internal manifold 220 passing from the inlet 218 and between the first wall 246 and the baffle 222. The construction of the breather 118, in particular the baffle 222 and the internal manifold 220, causes the flow of the blow-by gas to have to turn toward the mounting plate 204 and further turn back toward the direction of the outlet 206. More particularly, the baffle 222 can extend less than a full longitudinal length of the internal manifold 220 to allow for passage of the blow-by gas. The blow-by gas can be deflected to change flow direction by an end wall 248 and/or other feature(s) of the cover 202 toward the plate 224. The blow-by gas can pass through the plurality of apertures of the plate 224 to reach and infiltrate the filter media 226. The filter media 226 provides an impact surface for the oil of the blow-by gas.

At least a portion of the blow-by gas may not initially pass directly through the plate 224 to the filter media 226 but can be deflected by the plate 224 along a secondary flow path (indicated by arrow SFP). The secondary flow path SFP can be between the plate 224 and the baffle 222. This blow-by gas on the secondary flow path SPF can eventually pass through the plate 224 via apertures and join a primary flow path at a location downstream more toward the outlet 206. As shown in FIG. 6, at least a majority of the plate 224 can be spaced from the baffle 222. Indeed, only a small area of the baffle 222 and the plate 224 may be in contact. Like the baffle 222, the plate 224 can have an orientation that is inclined with respect to the first wall 246 of the housing 200 but declined with respect to the flow direction of the secondary flow path SPF. The orientation of the plate 224 can diverge from the baffle 222 to form a decreasing cross-sectional area along the secondary flow path SPF of the blow-by gas toward the outlet 206 within the internal manifold 220 passing between the plate 224 and the baffle 222. Thus, for example, the baffle 222 can be inclined (angled from the first wall) at an angle of 0.5 degrees and 5 degrees and the plate 224 can be inclined (angled from the first wall) at an angle of between 1.5 degrees and 6 degrees. The angle of the baffle 222 can differ from the angle of the plate 224 by between 0.5 degrees and 2.5 degrees. However, other angles and differences of inclination are contemplated according to other embodiments. A portion of the plate 224 and the baffle 222 is not inclined/generally straight but can be curved to direct flow to the outlet 206. Additionally, there can be a corresponding increasing cross-sectional area between the plate 224 and filter media 226 as the blow-by moves toward the outlet 206. This configuration minimizes blow-by airflow restriction as more gas passes thru the apertures in plate 224 into the exit flow. The configuration of the plate 224, the baffle 222 and the filter media 226 can achieve a low blow-by airflow velocity just prior to a bottom of the filter media 226 (adjacent the exit) so that coalesced oil that drains off of the filter media 226 is not re-entrained into the cleaned/exiting blow-by air flow.

Figure 7:
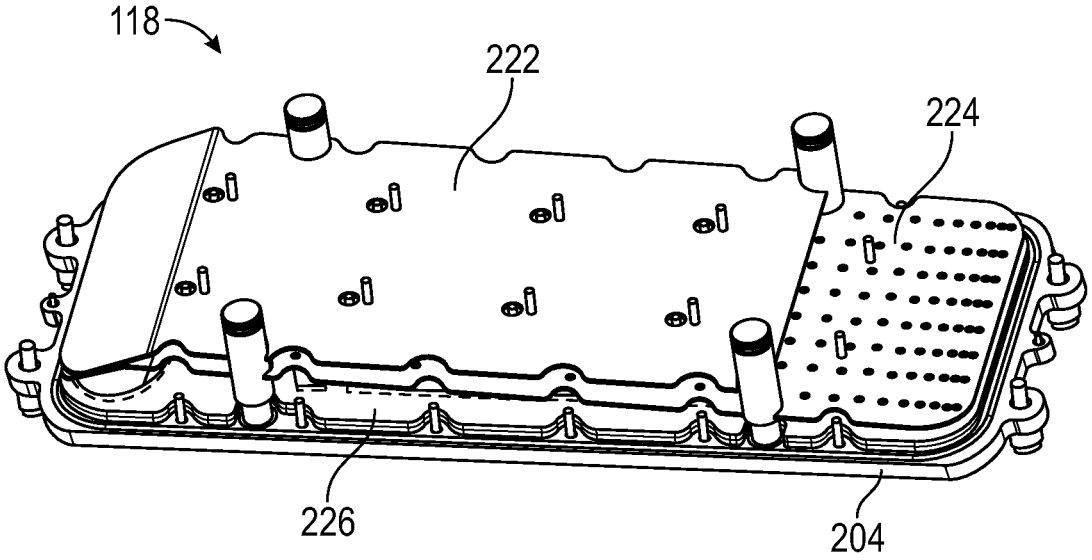
FIG. 7 is a perspective view of interior components of the breather with portions of a housing removed according to an example of the present application.
Figure 7A:
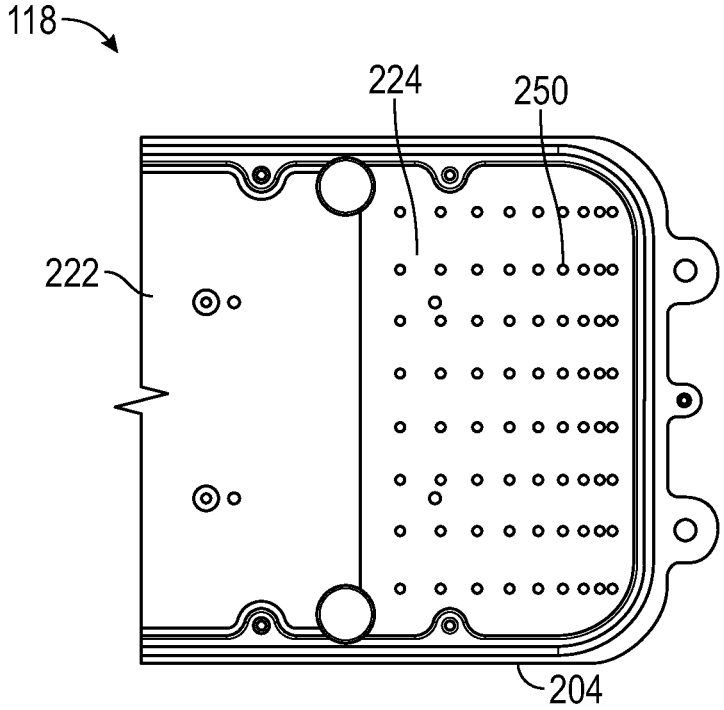
FIG. 7A is an enlarged plan view of part of the interior components of the breather of FIG. 7 including a plate with a plurality of apertures according to an example of the present application.

FIGS. 7 and 7A illustrate some components of the breather 118 in further detail. In FIGS. 7 and 7A, the cover 202 (FIG. 6) has been removed to illustrate further details of the mounting plate 204, the baffle 222, the plate 224 and the filter media 226 (shown only in FIG. 7). The baffle 222, the plate 224 and/or the filter media 226 can be supported on central portions by bosses (not shown) or other features. As shown in FIG. 7, the baffle 222 has a truncated longitudinal length relative to the plate 224 and the filter media 226. This length for the baffle 222 can be between 70 percent and 90 percent of the elongate length of the plate 224 and/or the filter media 226. This different length for the baffle 222 allows for the turning/deflection of the blow-by gas through a primary flow path to the filter media 226 as discussed previously above. FIGS. 7 and 7A show the plate 224 with a first plurality of apertures 250 along the portion of the plate 224 not interfacing with and covered by the baffle 222. As shown in FIG. 7A, a number, and hence density, of the first plurality of apertures 250 can increase adjacent the end wall of the cover (not shown) and the mounting plate 204. Thus, the density of the first plurality of apertures 250 increases as the blow-by gas travels further away from the baffle 222. This decrease in the spacing of the first plurality of apertures 250 (the higher density) can offset or partially offset a drop in flow pressure in the blow-by gas adjacent the end wall of the cover. A diameter of the first plurality of apertures 250 can be between 2 mm and 6 mm, for example. The number of the first plurality of apertures 250 can be between 50 and 100. However, the locations, numbers, spacing and size of the first plurality of apertures 250 is purely exemplary and would be altered based upon a number of factors including mass flow rate through the breather 118, for example.

Figure 8:
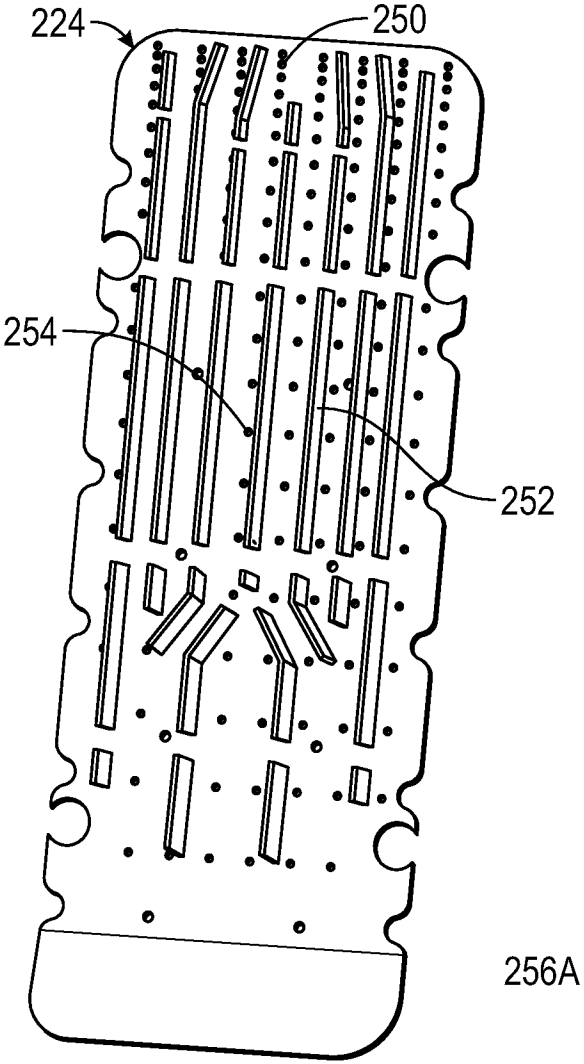
FIG. 8 is a perspective view of the plate according to an example of the present application.

FIG. 8 shows the plate 224 in further detail. The plate 224 includes the first plurality of apertures 250 for passage of the blow-by gas as discussed in FIGS. 6-7A. The plate 224 can additionally include standoffs 252 and a second plurality of apertures 254. The second plurality of apertures 254 can be located on other longitudinal sections of the plate 224 from the first plurality of apertures 250. These other longitudinal sections can be covered by and interface with the baffle 222 (FIGS. 6-7A) for example. A density of the second plurality of apertures 254 can be less than the density of the first plurality of apertures 250. The second plurality of apertures 254 can allow for passage of the blow-by gas from the secondary flow path to pass through the plate 224 to reach the filter media 226 (FIGS. 6 and 7). A diameter of the second plurality of apertures 254 can be between 2 mm and 6 mm, for example. Overall, a number of the first plurality of apertures 250 and the second plurality of apertures 254 can between 150 and 300. Apertures can be linearly spaced (as shown) or can be spaced in another pattern (e.g., curved, zigzag, non-linear, etc.). The locations, numbers, spacing and size of the second plurality of apertures 254 is purely exemplary and would be altered based upon a number of factors including mass flow rate through the breather 118, for example. The standoffs 252 can be constructed as fins to provide a desired spacing of the plate 224 from the filter media 226 (FIGS. 6 and 7) and/or the baffle 222 (FIGS. 6-7A). Thus, the standoffs 252 (when configured as fins) can direct the flow of blow-by gas toward the outlet 206 and assist in retaining the filter media 226 against the mounting plate 204. Other features such as cut-outs for allowing passage of bosses and jumper tubes are shown in FIG. 8. Thus, as shown in FIG. 8, the plate 224 has an increased density of the plurality of apertures (the first plurality of apertures 250) along a first portion thereof as compared with a second portion thereof (the second plurality of apertures 254). The first portion is not covered by the baffle 222 (as shown in FIGS. 7 and 7A). The second portion (with the second plurality of apertures 254) can be between 70 percent and 90 percent of a total surface area of the plate 224.

Figure 9:
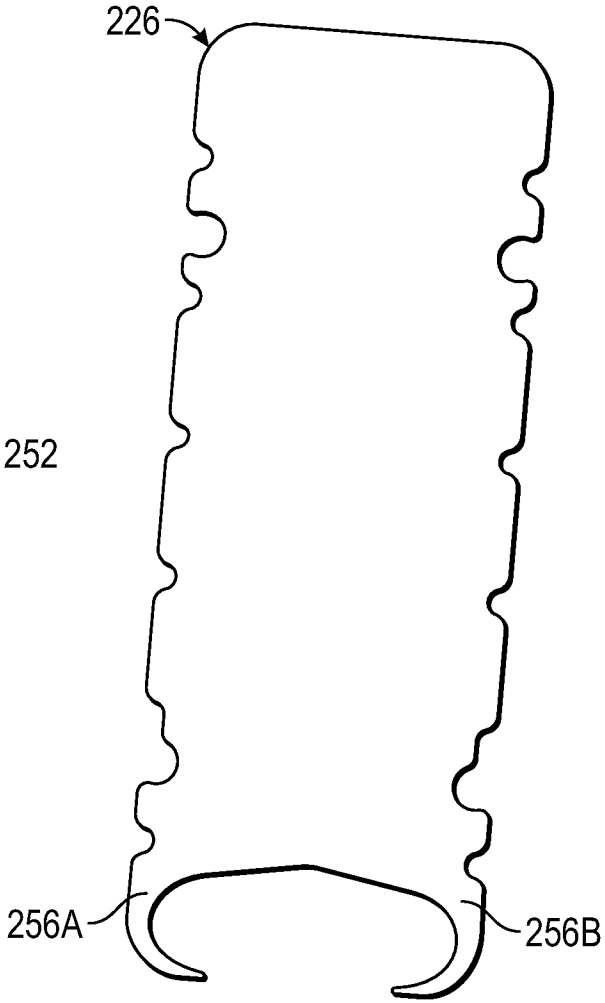
FIG. 9 is a perspective view of a filter media of the breather according to an example of the present application.

FIG. 9 shows an example of the filter media 226. The filter media 226 can comprise a single layer or multiple layers of felt or other suitable oil capturing material. A thickness of the filter media 226 can be between 3 mm and 12 mm, for example. The filter media 226 can be shaped to extend around the outlet (not shown) of the breather and can include fingers 256A and 256B. The fingers 256A and 256B can be designed to pass captured oil of filter media 226 around the outlet and to the oil outlets that connect with one or more passages of the inlet cover 210 (FIG. 5) of the oil separating apparatus 104 (FIG. 5). Alternatively, the oil outlets can drain to another location such as via line, pipe, tube, etc. back to the engine, other portions of the oil separating apparatus 104 (FIG. 2), or another location. The drainage of the oil from a remainder of the filter media 226 to the fingers 256A and 256B can be facilitated by gravity due to the orientation of the breather 118 generally vertically with the outlets and fingers 256A and 256B at a bottom as shown in FIGS. 2-5.

Figure 10:
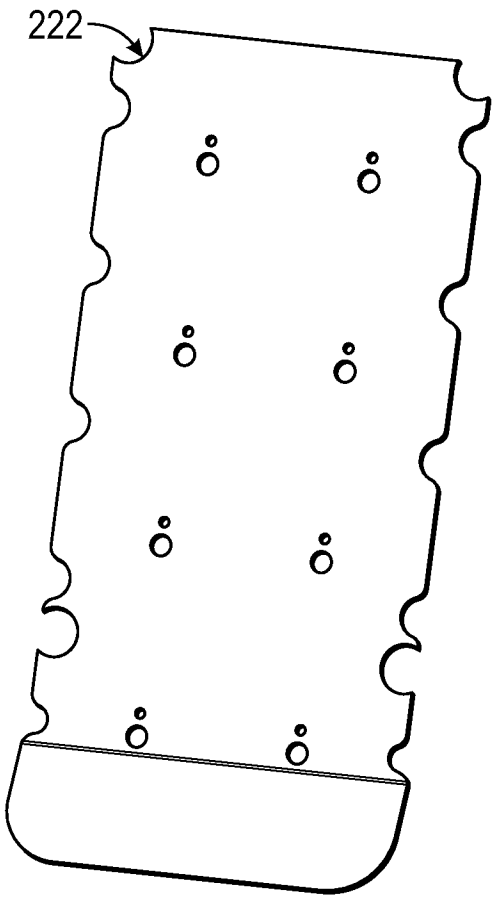
FIG. 10 is a perspective view of a baffle of the breather according to an example of the present application.

FIG. 10 shows the baffle 222 according to one example. The baffle 222 includes a curved portion and a straight/inclined portion as previously discussed. Features such as cut-outs and apertures are utilized for coupling/passage of bosses and jumper tubes, for example. The curved portion can have a 25 degree bend, for example. The baffle 222 can be constructed of a sheet metal and can have a thickness of between 1 mm and 4 mm, for example.

Figure 11:
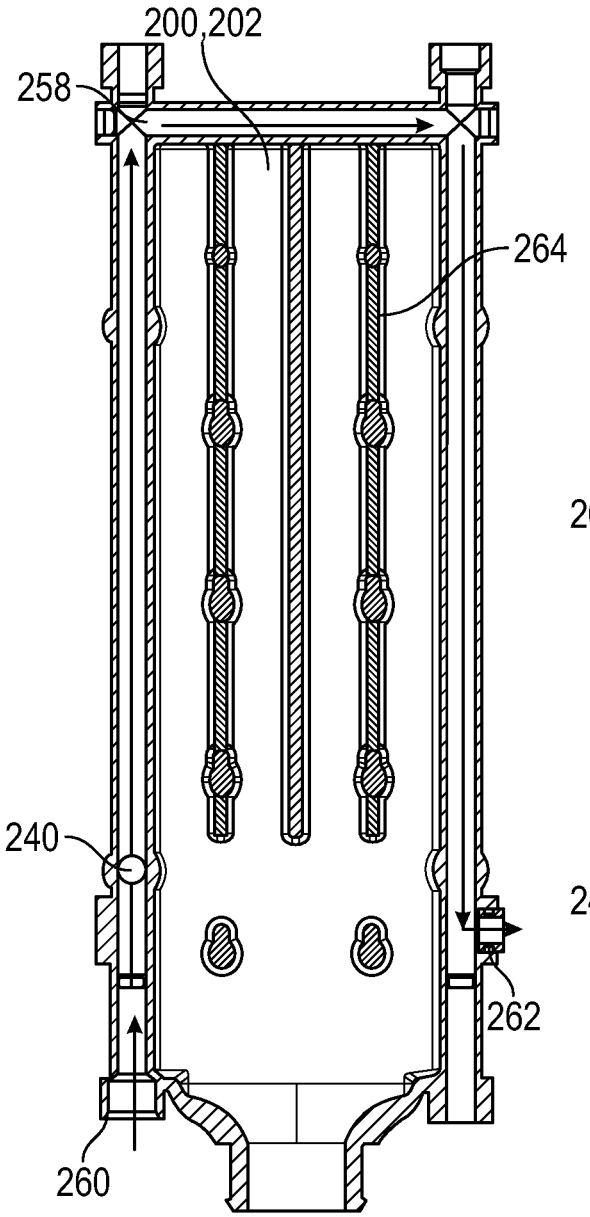
FIG. 11 is a cross-sectional view of a portion of a housing of the breather having passages therein for communicating a warming fluid according to an example of the present application.

FIG. 11 is a cross-sectional view of the housing 200, in particular, the cover 202 schematically illustrating an exemplary flow circuit for the fluid previously discussed with regards to FIGS. 1 and 5. The fluid can be used to heat or maintain a temperature of the housing 200, and hence, the filter media (not shown) of the breather 118. The flow circuit can be facilitated by passages 258 that extend within the cover 202. The passages 258 can communicate with an inlet 260 and an outlet 262. Additionally, the passages 258 can communicate with the jumper tube 240 (see also FIG. 12) as previously described in reference to FIG. 5. The passages 258 can extend around all or a portion of a perimeter of the cover 202, for example. Although not illustrated in FIG. 11, further portions of the passages 258 can extend on an interior section of the cover 202 such as along the internal manifold within fins 264 or bosses or other features of the cover 202.

Figure 12:
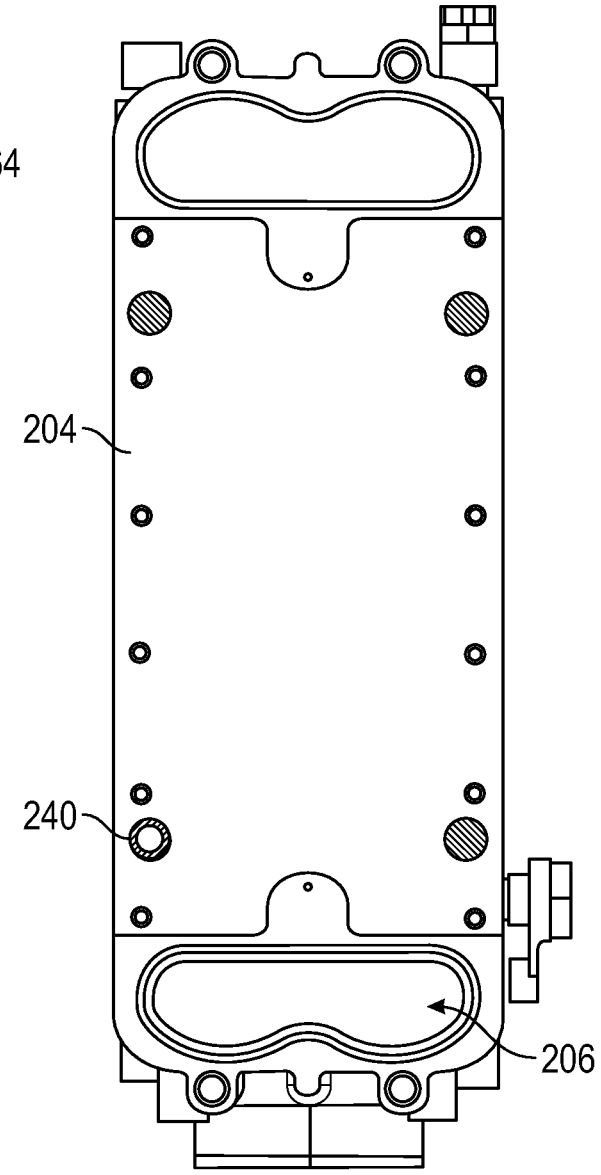
FIG. 12 shows a wall of the housing of the breather including a jumper tube for communicating with the passages of FIG. 11 according to an example of the present application.

Referring now to FIGS. 11 and 12, in operation, the fluid flowing through the passages 258 can warm the cover 202. The mounting plate 204 (FIG. 12) attached to the cover 202 (FIG. 11) can be mounted to the oil separating apparatus and can be warmed by the fluid passing through the jacket(s) of the oil separating apparatus or insulated by the oil separating apparatus. Additionally, internally the baffle (not shown) can be shaped and positioned within the breather 118 to keep the initial flow of blow-by gas initially against the heated cover 202 until the flow of the blow-by gas gets to the end wall where it can be deflected to change direction as described previously and pass through the plurality of apertures in the plate to the filter media.

Figure 12A:
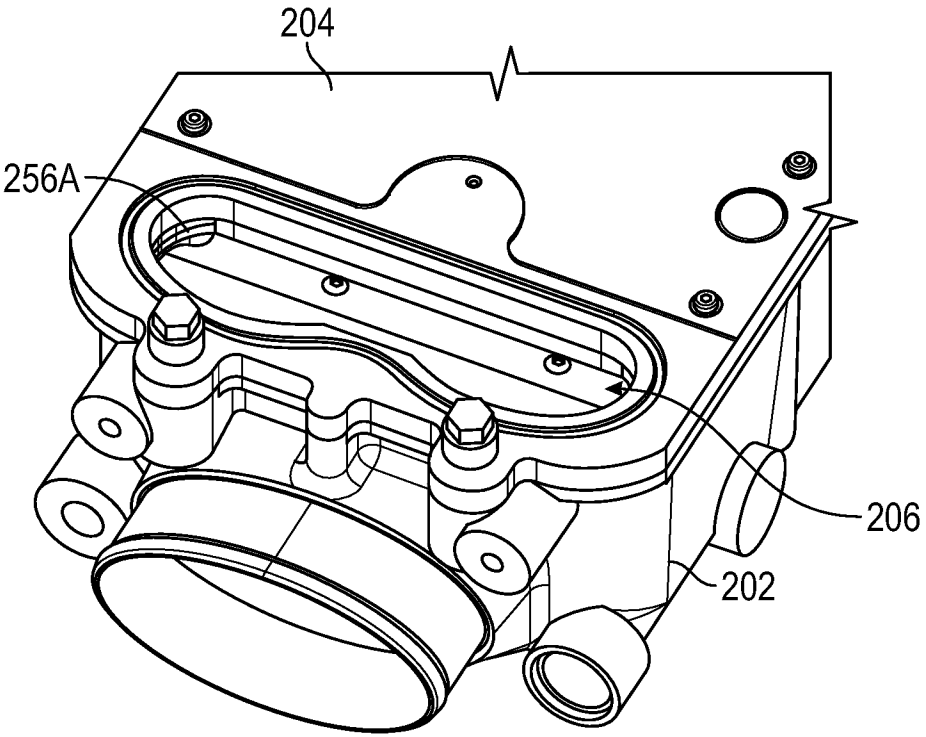
FIG. 12A is an enlarged view of a portion of the breather that includes the inlet and outlet to an internal manifold.

FIG. 12 additionally illustrates the mounting plate 204 with the outlet 206 and the jumper tube 240. FIG. 12A is an enlarged view of a portion of the mounting plate 204 and cover 202. FIG. 12A shows the outlet 206 in close proximity to the fingers (specifically finger 256A) of the filter media 226. The captured oil can be passed to the oil separation apparatus from the filter media 226 as discussed previously or can be passed to another passage and away from the breather 118.

Figure 13:
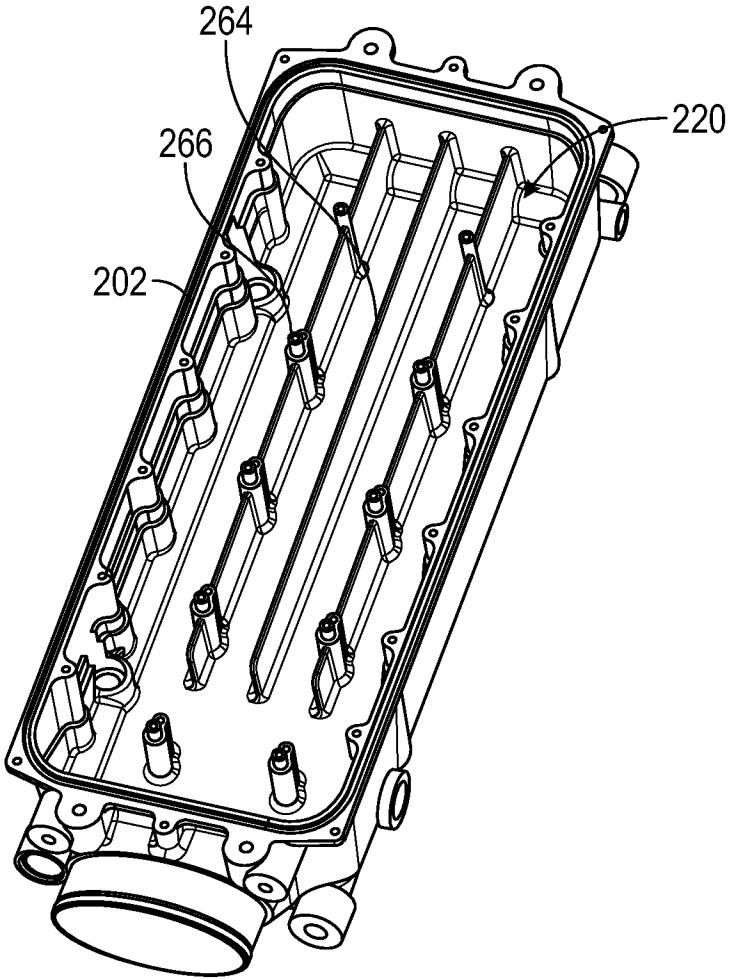
FIG. 13 is a cross-sectional view of a portion of the housing of the breather having passages including fins for communicating the warming fluid according to an example of the present application.

FIG. 13 shows fins 264 and bosses 266 internal to the cover 202 in further detail. These fins 264 and the bosses 266 are within and extend longitudinally along the internal manifold 220. The fins 264 can be used to direct the flow of the blow-by gas. The bosses 266 can be used to support internal components such as the baffle, the filter media and/or the plate as previously discussed and illustrated.

INDUSTRIAL APPLICABILITY

In operation, the engine 100 can be configured to combust fuel to generate power. While typically efficient, a small portion of the combustion gases may escape the combustion chamber past the piston as blow-by and enter undesirable areas of the engine 100 such as the crankcase. The present disclosure contemplates the system 102 including the breather 118 and one or more oil separating apparatuses 104 to filter oil to remove the oil from the blow-by gas.

Breathers and oil separating apparatuses containing coalescing filters are known, however, these have disadvantages. Regarding breathers, these are typically located on the crankcase such as mounted to valve covers, a rear housing, etc. However, space around the crankcase has become increasingly limited with modern engine design such that locating breathers in these and other locations has become increasingly difficult. In some cases, if breathers are shrunk to meet size constraints their flow capacity and operational effectiveness to capture oil can become limited. The present application recognizes a construction for the breather 118 that has a very high flow capacity, a low restriction, and can be spaced remote from the crankcase in a location with greater flexibility in terms of a size and shape for the breather 118.

Additionally, both breathers and oil separating apparatuses using coalescing filters typically lack cold climate capability. The present application recognizes the breather 118 and the oil separating apparatus 104 can have a heating capability. This is because the breather 118 can have the passages 258 internal thereto for the supplemental energy fluid and the oil separating apparatus 104 can utilize the jacket 234 for the supplemental energy fluid (or a different separate fluid). These features can receive the fluid(s) to cool, insulate, and/or warm the filter media 226 and/or filter media 232 of the breather 118 and/or the oil separating apparatuses 104 to a desired temperature range. This improves operation of the filter media 226 and filter media 232 in cold climate or high heat environments. Thus, the design of the breather 118 and the oil separating apparatuses 104 can have improved temperature robustness. Thus, the present breather 118 and the oil separating apparatuses 104 can be configured to reduce or prevent heat loss, water condensate, oil/water emulsion, and/or freezing that can negatively impact engine performance.

Breathers and oil separating apparatuses known in the art are often purpose-built solutions. As such, these devices do not offer the configurability, commonality, scalability and modularity needed to address a wide range of multi-displacement and different power density engine platforms. The present breather 118 and oil separating apparatuses 104 can be configurable as assemblies such as arrays. This modularity (a desired number of breather(s) and a desired number of oil separating apparatuses can be easily selected and implemented together as an assembly) can provide for the configurability, commonality, scalability and modularity needed to address various engine platforms. The assemblies described can be easily constructed to handle various volumes of blow-by gas and other fluids as desired for various engine and/or auxiliary component needs.

The present application recognizes the breather 118 and the oil separating apparatuses 104 can be modularly packaged together. This can better allow these devices to be accommodated into engines having tight spacing requirements. The present breather 118 and the oil separating apparatus 104 assemblies can mount the breather 118 directly to the oil separating apparatus 104. This arrangement allows for an outlet of the breather 118 to communicate directly with an inlet of the oil separating apparatus 104 with no intermediate component therebetween facilitating communication. This can better protect the blow-by gas from the environment and can reduced the size of the assembly of the breather 118 and the oil separating apparatus 104. Additionally, this assembly arrangement can allow for the fluid to be supplied between the oil separating apparatus 104 and the breather 118 in various directions as desired such as via the jumper tube 240. This assembly arrangement can also facilitate drainage of oil from both the filter media 226 and the sump created within manifold 236 to a common oil outlet port reducing the number of tubes, pipes, hoses, etc. used with the engine 100.

The above detailed description is intended to be illustrative, and not restrictive. The scope of the disclosure should, therefore, be determined with references to the appended claims, along with the full scope of equivalents to which such claims are entitled.

What is claimed is:

1. A breather for a ventilation system of an internal combustion engine, comprising:

a housing forming an inlet, an outlet and an internal manifold in fluid communication with the inlet and the outlet, wherein at least a first portion of the housing forms a flow passage separate from the internal manifold for receiving a heated fluid that warms the internal manifold and the at least the first portion of the housing;

a baffle positioned in the internal manifold;

a plate positioned in the internal manifold, wherein the plate includes a plurality of apertures; and a filter media in the internal manifold adjacent the plate; and wherein at least a majority of the baffle has an orientation that is inclined with respect to a first wall of the housing, and wherein the orientation of the baffle provides for an increasing cross-sectional area along an initial flow path of a blow-by gas within the internal manifold passing between the first wall and the baffle.

2. The breather of claim 1, wherein at least a majority of the plate is spaced from the baffle and has an orientation that is inclined with respect to the first wall of the housing, wherein the orientation of the plate diverges from the baffle to form a decreasing cross-sectional area along a second flow path of the blow-by gas within the internal manifold passing between the plate and the baffle.

3. The breather of claim 2, wherein the plate and filter media are oriented relative to one another with an increasing cross-sectional area between the plate and the filter media as the blow-by gas moves toward the outlet.

4. The breather of claim 1, wherein the housing is configured to mount directly on an oil separating apparatus, the oil separating apparatus having an oil separating apparatus housing with an oil separating apparatus inlet and an oil separating apparatus outlet, such that the outlet of the breather communicates directly with an inlet of the oil separating housing with no intermediate component therebetween facilitating communication.

5. The breather of claim 4, wherein oil captured by the filter media within the breather is passed to the oil separating apparatus.

6. The breather of claim 4, wherein the heated fluid passes between the breather to a jacket of the oil separating apparatus.

7. The breather of claim 6, wherein a second portion of the housing opposes the at least the first portion of the housing, wherein the second portion interfaces with and is directly adjacent the jacket of the oil separating apparatus.

8. A breather for a ventilation system of an internal combustion engine, comprising:

a housing forming an inlet, an outlet and an internal manifold in fluid communication with the inlet and the outlet, wherein at least a first portion of the housing forms a flow passage separate from the internal manifold for receiving a heated fluid that warms the internal manifold and the at least the first portion of the housing;

a baffle positioned in the internal manifold;

a plate positioned in the internal manifold, wherein the plate includes a plurality of apertures; and a filter media in the internal manifold adjacent the plate, wherein the plate has an increased density of the plurality of apertures along a first portion thereof as compared with a second portion thereof, and wherein the first portion is not covered by the baffle.

9. The breather of claim 8, wherein the second portion is between 70 percent and 90 percent of a total surface area of the plate.

10. An engine system comprising:

an internal combustion engine having a crankcase configured to have a blow-by gas passing therethrough;

a breather remote from the crankcase and configured to be in fluid communication with the blow-by gas, the breather having a breather housing with a breather inlet and a breather outlet, the breather inlet configured to receive blow-by gas from the crankcase and the breather outlet configured to discharge blow-by gas from the breather, wherein the breather is configured to separate oil from the blow-by gas within the breather housing between the breather inlet and the breather outlet with a first filter media; and an oil separating apparatus having an oil separating apparatus housing with an oil separating apparatus inlet configured to receive blow-by gas from the breather inlet and an oil separating apparatus outlet configured to discharge blow-by gas from the oil separating apparatus, the oil separating apparatus configured to be in fluid communication with the blow-by gas discharged from the breather and configured to further separate oil from the blow-by gas with a second filter media within the oil separating apparatus housing between the oil separating apparatus inlet and the oil separating apparatus outlet;

wherein the breather and the oil separating apparatus are coupled directly together at the breather outlet and the oil separating apparatus inlet such that the breather outlet of the breather fluidly communicates directly with the oil separating apparatus inlet of the oil separating apparatus with no intermediate component therebetween facilitating fluid communication.

11. The engine system of claim 10, wherein separate from the blow-by gas, the breather and the oil separating apparatus are configured to be in fluid communication with an engine fluid that warms both the first filter media and the second filter media.

12. The engine system of claim 11, wherein the breather includes a jumper tube that passes through a wall of a housing of the breather and is configured to fluidly connect with a jacket of the oil separating apparatus to pass at least some the fluid between the breather and the oil separating apparatus.

13. The engine system of claim 10, wherein oil captured by the first filter media of the breather is passed to the oil separating apparatus.

14. The engine system of claim 10, wherein the breather includes:

the breather housing having an internal breather manifold in fluid communication with the breather inlet and the breather outlet, wherein at least a first portion of the housing forms a flow passage separate from the internal breather manifold for receiving a heated fluid that warms the internal breather manifold and the at least the first portion of the housing;

a baffle positioned in the internal breather manifold;

a plate positioned in the internal breather manifold, wherein the plate includes a plurality of apertures; and the first filter media in the internal breather manifold adjacent the plate.

15. The engine system of claim 10, wherein at least a majority of the baffle has an orientation that is inclined with respect to a first wall of the housing, wherein the orientation of the baffle provides for an increasing cross-sectional area along an initial flow path of a blow-by gas within the internal breather manifold passing between the wall and the baffle, wherein at least a majority of the plate is spaced from the baffle and has an orientation that is inclined with respect to the wall of the housing, wherein the orientation of the plate diverges from the baffle to form a decreasing cross-sectional area along a second flow path of the blow-by gas within the internal breather manifold passing between the plate and the baffle, and wherein the plate and first filter media are oriented to have an increasing cross-sectional area between the plate and the first filter media as the blow-by gas moves toward the breather outlet.

16. A method of filtering oil from a blow-by gas of an internal combustion engine, the method comprising:

passing the blow-by gas from a crankcase of the internal combustion engine to a breather remote from the crankcase, the breather having a breather housing with a breather inlet and a breather outlet, and a first filter media within the breather housing and fluidly between the breather inlet and the breather outlet, the blow-by gas entering the breather through the breather inlet of the breather;

separating a first amount of oil from the blow-by gas with the first filter media within the breather housing;

passing the blow-by gas from the breather outlet of the breather directly to an oil separating apparatus inlet of an oil separating apparatus, the oil separating apparatus having an oil separating apparatus housing with the oil separating apparatus inlet, an oil separating apparatus outlet, and a second filter media within the oil separating housing and fluidly between the oil separating apparatus inlet and the oil separating apparatus outlet;

separating a second amount of oil from the blow-by gas with the second filter media within the oil separating apparatus housing; and passing the blow-by gas from the oil separating apparatus outlet of the oil separating apparatus back to the crankcase.

17. The method of claim 16, further comprising passing the first amount of oil separated by the first filter media and the second amount of oil separated by the second filter media back to the internal combustion engine.

18. The method of claim 16, wherein the separating the first amount of oil from the blow-by gas with the first filter media within the breather housing includes passing the blow-by gas through a plurality of apertures defined by a plate positioned in an internal manifold of the breather to reach the first filter media.

19. The method of claim 16, further comprising warming the blow-by gas with a separate fluid passed in a heat exchange relationship with the blow-by through passages of the breather and the oil separating apparatus, wherein the warming the blow-by gas includes passing the blow-by gas through the breather between the passages of the breather and the passages of the oil separating apparatus.

* * * * *